United States Patent [19]

Beaujean et al.

[11] Patent Number: 4,963,158

[45] Date of Patent: Oct. 16, 1990

[54] MACHINE WASHING PROCESS FOR SOILED TEXTILE ARTICLES

[75] Inventors: Hans-Josef Beaujean, Hilden; Horst Eisenblaetter, Duesseldorf; Johann F. Fues, Grevenbroich; Brigitte Giesen, Duesseldorf-Grafenberg; Erich Holz, Duesseldorf; Ulrich Jahnke, Monheim; Werner Kuenzel, Langenfeld; Alfred Meffert, Monheim; Karl Schwadtke, Leverkusen; Eduard Smulders, Hilden; Eric Sung, Monheim; Andreas Syldatk, Duesseldorf; Hans-Georg Toelken, Duesseldorf; Ingo Wegener, Duesseldorf, all of Fed. Rep. of Germany

[73] Assignee: Henkel Kommanditgesellschaft auf Aktien, Duesseldorf-Holthausen, Fed. Rep. of Germany

[21] Appl. No.: 308,171

[22] Filed: Feb. 8, 1989

[30] Foreign Application Priority Data

Feb. 8, 1988 [DE] Fed. Rep. of Germany ..... 38037246
Jul. 15, 1988 [DE] Fed. Rep. of Germany ..... 38239779
Nov. 10, 1988 [EP] European Pat. Off. ..... 881187322

[51] Int. Cl.[5] ..... C11D 17/04

[52] U.S. Cl. ..... 8/137; 252/90; 252/91

[58] Field of Search ..... 8/137, 158, 159; 252/90, 91

[56] References Cited

U.S. PATENT DOCUMENTS

| | | | |
|---|---|---|---|
| 3,664,961 | 5/1972 | Norris | 252/99 |
| 3,936,537 | 2/1976 | Baskerville, Jr. et al. | 427/242 |
| 4,222,905 | 9/1980 | Cockrell | 252/547 |
| 4,239,659 | 12/1980 | Murphy | 252/524 |
| 4,356,099 | 10/1982 | Davies et al. | 252/90 |
| 4,610,799 | 9/1986 | Wilsberg et al. | 252/90 |
| 4,703,872 | 11/1987 | Cornette et al. | 222/158 |
| 4,784,666 | 11/1988 | Brenner et al. | 8/137 |

FOREIGN PATENT DOCUMENTS

| | | |
|---|---|---|
| 0244796 | 11/1987 | European Pat. Off. . |
| 0253151 | 1/1988 | European Pat. Off. . |
| 1617139 | 3/1971 | Fed. Rep. of Germany . |
| 2299447 | 8/1976 | France . |

OTHER PUBLICATIONS

"Enzyklopadie der Technischen Chemie" 4th Edition, vol. 24, Detergents, in particular loc. cit. pp. 68 to 102.

*Primary Examiner*—Paul Lieberman
*Assistant Examiner*—John F. McNally
*Attorney, Agent, or Firm*—Ernest G. Szoke; Wayne C. Jaeschke; Real J. Grandmaison

[57] ABSTRACT

Soiled textile articles are washed by the addition of a determined amount of a detergent concentrate containing surfactants to the textile articles to be cleaned while the textiles are dry or only damp. The aqueous washing liquor is formed by the gradual addition of water to the textile articles while they are rotated. At room temperature, the detergent concentrate is to a substantial extent a paste-to dough-like substance, stable in form, and is applied to the textile articles in such an amount that the major portion of the surfactants together with further detergent constituents, if desired, are applied to the textiles or on an article of textile provided with markings for the correct detergent dose, as a dosing aid.

12 Claims, 1 Drawing Sheet

MACHINE WASHING PROCESS FOR SOILED TEXTILE ARTICLES

BACKGROUND OF THE INVENTION

1. Field of the Invention

This invention relates to an improvement and simplification of the domestic and/or commercial machine washing of soiled textile articles by a process in which the aqueous washing liquor is formed in the presence of the soiled textile articles in such a way that a concentrate containing detergent constituents and in particular surfactants, is added directly to the dry or slightly damp textile articles and the washing liquor is formed in situ preferably by the gradual addition of water and rotation of the textile articles. The subsequent description of the invention is provided relative to the usual domestic washing machines of today. However, its essential process parameters can be used to advantage in the same way for commercial washing in corresponding laundries or washing plants.

2. Statement of Related Art

In practically all types of washing machines in use today the formation of the washing liquor takes place as follows: a measured amount of detergent is put into a dispenser and from there it is flushed into the machine by the water flowing into the machine. In a comparatively short initial period the desired end-concentration of the washing liquor is formed, in which the washing process is then carried out.

The detergents to be found on the market today are usually solid, crumbly powders, granulated substances or pourable liquids. The use of liquid detergents containing surfactant can cause difficulties in the usual domestic washing machines used in Europe because the soap dispensers which are available to take up an amount of powder are not however suitable for holding liquid concentrates there until they must be flushed into the body of the machine at the desired time of the washing cycle.

The prior art provides two basic ways for solving these difficulties. The first method is described, for example, in European patent specification No. 0 040 931. Described therein is the addition of a quantity of liquid detergent concentrate such that this concentrate is packaged in closed bags which are added to the textile articles before the start of the washing process. In such case the liquid detergent concentrate is packaged in a thermoplastic bag which is insoluble and impervious to water, and which, however, is closed by a mechanically weak hot seal such that this seal opens under mechanical action in the washing machine. This opening of the predetermined fracture location in the dosing bag should preferably take place within the first 5 minutes, and particularly within the first 2 minutes, after the start of the washing process.

The other proposed solution of the prior art is described, for example, in German patent application No. 35 12 050. Here, a process for cleaning of articles to be washed in a washing machine with a liquid detergent is described which is characterised in that the detergent concentrate is put in a dosage container which has permanent openings, for example, in a suitable dosage container in the shape of a ball. This dosage container, which is filled with detergent concentrate, is placed with the textile articles before the start of the washing process. If the washing cycle in the machine is then carried out with rotation of the textile articles in the usual way, then the liquid detergent concentrate is gradually dispensed from the container into the washing medium. The dosage container is removed from the machine after completion of the wash cycle and can be re-filled with liquid detergent concentrate and used again.

Both proposals of the afore-described prior art claim the advantage over the conventional use of the soap dispenser that fewer or no losses of detergent or detergent concentrate occur in the liquor sump, which according to present knowledge of machine technology can always form if the detergent concentrate is flushed into the machine with a little water and in this form sinks into a liquor sump. Additional means are needed, for example, the deliberate pumping around of the liquor sump, in order to prevent the loss of detergent components arising because of this in the main cycle of the machine process.

An object of this invention is the further improvement of textile machine washing wherein the detergent concentrate is directly added to the textile articles, and the formation of the washing liquor takes place in situ by the addition of water to the soiled textile articles containing the detergent concentrate.

A particular object of this invention is to provide the possibility of eliminating dosage elements such as packing bags or permanently open, re-usable dosage containers of the type previously described. In contrast, the teaching of this invention is based on the concept that a detergent concentrate is added to the textile articles to be washed as a substance at least to a large extent stable in form at room temperature, or on an article of textile which serves as a dosing agent, and the washing liquor is then formed in situ by the addition of water.

DESCRIPTION OF THE INVENTION

Other than in the operating examples, or where otherwise indicated, all numbers expressing quantities of ingredients or reaction conditions used herein are to be understood as modified in all instances by the term a "about".

The subject of this invention is accordingly an improved process for the machine washing of soiled textile articles with an aqueous, wash-active washing liquor containing surfactants by the addition of a determined amount of detergent concentrate containing surfactants directly on the textile articles to be cleaned and the consequent formation of the washing liquor preferably by gradual addition of water and rotation of the textile articles, whereby the process is characterized in that at least the major part of the wash-active surfactants together with, if desired, further detergent constituents are applied to the still dry and/or slightly damp textile articles as a paste- to a dough-like preparation, and which at least to a substantial extent is stable in form at room temperature. In a preferred embodiment of the invention, at least to the greatest possible extent, form-stable pastes or dough-like detergent concentrates are used which under the standard conditions described in the following, have a dissolving power of at least 40% by weight and preferably of at least 50% by weight.

1 g of the paste- to dough-like detergent concentrate is put into a glass beaker (250 $cm^3$, diameter approximately 5.5 cm) as a coherent test material and mixed with 100 ml of water at a temperature of 20°+2° C. A magnetic stirring rod (length 3 cm) is put in the glass beaker. The contents of the beaker are then stirred at the given temperature at a rotation speed of 500 r.p.m. for a period of 15 minutes. In a preferred embodiment of the invention, gel- or paste-like detergent concentrates are used, which under the given conditions are converted within a period of 5 minutes to at least 50%, preferably to at least 75% and in particular to at least 85%, into a clear or finely dispersed solution. To be considered here is that the detergent concentrate can contain, as known per se, water-insoluble, finely-divided active materials, for example "builder" constituents based on zeolite NaA, or finely divided layered silicate of natural and/or synthetic origin, and also difficultly soluble surfactant components in finely-divided form such as fatty alcohol sulphate and di-salts of alpha-sulfo fatty acids and the like which are substantially insoluble at room temperature.

It is critical for the useability of the paste- or dough-like detergent preparations in accordance with the invention that at least the greater part of the coherent material test sample should break down into clear solutions or finely dispersed suspensions under the comparatively mild conditions of the tests given here. This prerequisite is easily determinable, visually or by technical measuring means, in the given test. In particular, here, the less suitable or unsuitable detergent preparations can be evaluated, which remain in the test as mainly undissolved or only insufficiently dissolved, generally coherent material samples and thereby signal difficulties for the formation of a homogeneous washing liquor in the machine which is loaded with textiles. Correspondingly, unsatisfactory detergent preparations are often indicated by a too high content of difficultly soluble surfactant components and/or surfactant components with a high tendency to gel. Fundamentally, such mixtures of substances can also be converted into usable preparations within the scope of the process according to the invention, as is described in the following.

Figure 1:
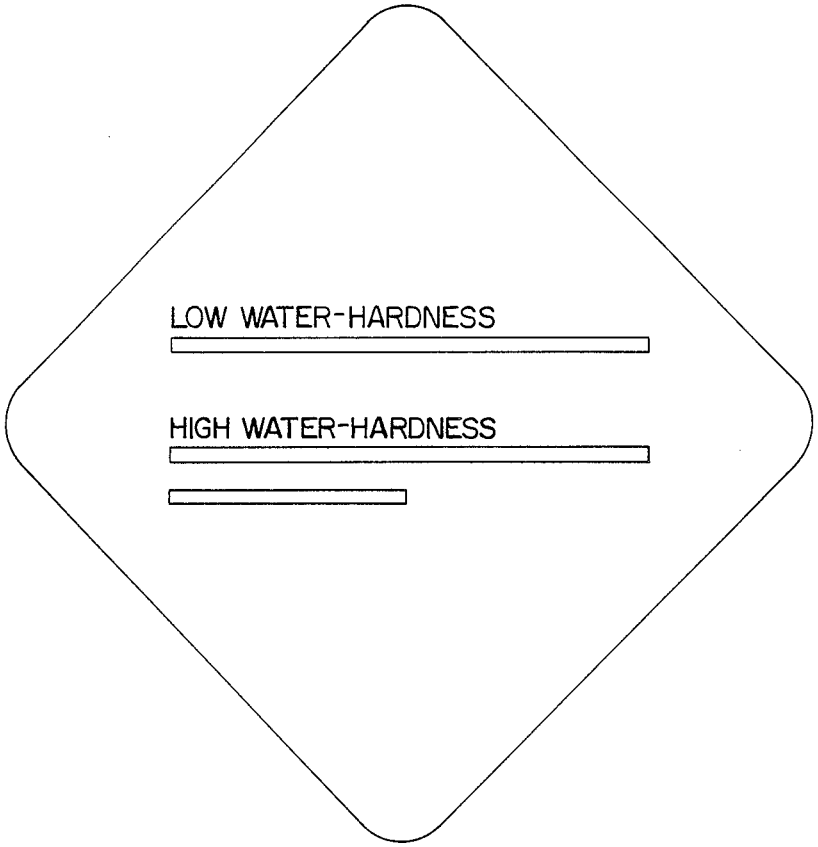
FIG. 1 illustrates a dosing-cloth containing markings to determine the required strand length of paste-like detergent concentrate for a full machine load of textile articles to be washed depending on the hardness of the water used for working.

In one of the embodiments of the invention, detergent concentrates containing water and/or water soluble solvents are used in a preparation having a spreadable to kneadable consistency, wherein the surfactant content does not exceed about 75% by weight, preferably about 60% by weight and more preferably about 50% by weight. The % by weight in each case refers to the weight of the detergent concentrate.

In order to meet the requirement of quickly and evenly dissolving the detergent concentrate by adding water to the textile articles in the machine, it can be useful to add dispersing agents to the detergent concentrate which contribute to an easier dissolution of the paste- or dough-like detergent concentrate. The addition of such dispersing agents is advisable in particular for the presence of surfactants which are difficultly soluble or tend to gel in water at room temperature. Examples of such surfactants, which are difficultly soluble at room temperature include tallow fatty alcohol sulphate paste and other pastes based on long-chain fatty alcohol sulphates, long-chain alkyl glycosides, long-chain ethanolamides, $C_{16-18}$-ester sulfonate and soap.

The dissolution of detergent concentrates of the type herein based on such surfactants or surfactant combinations which strongly tend toward gel formation can involve difficulties. Examples of such are the highly concentrated pastes based on a fatty alcohol ether sulphate (FAES), for example, corresponding to about 70% by wt. FAES-paste. Further examples of this tendency to gel formation are long-chain saturated fatty alcohol ethoxylates, which in addition to the tendency to form gel, only dissolve at a moderate speed. Additional examples include components which are derived from $C_{16-18}$ or longer-chain components.

In connection with avoiding the formation of gel, secondary alkane sulfonates, such as saturated $C_{12-14}$, or $C_{12-18}$ fatty alcohol ethoxylates with at least on average 10 mole of ethylene oxide, the corresponding unsaturated fatty alcohol ethoxylates, and also such components based on unsaturated $C_{16-18}$-fatty alcohol, for example, produce fewer gel problems.

In comparison, an insignificant number of problems are caused with regard to moderate solubility by coconut fatty alcohol sulfate pastes, $C_{12-14}$-alkyl glycosides, $C_{12-14}$-ester sulfonates and sulfosuccinates.

A great many soluble washing active components, although possibly also insoluble at low temperatures, cause no problems in use and in the dissolving behaviour of the pasty to doughy preparations. As examples, the following can be named; alkyl benzene sulfonate, nonyl phenol ethoxylate, maximum of about 30% FAES-solutions, saturated fatty alcohol ethoxylate based on $C_{12-14}$- or $C_{12-14}$-fatty alcohol with on average 5 to 7 moles of ethylene oxide, unsaturated fatty alcohol ethoxylate based on $C_{16-18}$-fatty alcohol with 5 to 6 moles of ethylene oxide, short-chain alkyl glycoside, oxoalcohol ethoxylate based on $C_{12-15}$-oxoalcohol with 5 to 9 moles of ethylene oxide, amphoterics, and also di-salts, which are to a large extent insoluble at room temperature, in particular sodium di-salts of alpha-sulfo fatty acids with predominantly $C_{16-18}$-fatty acids in the fatty acid radical.

Organic and/or inorganic additives, which can be of a surfactant or non-surfactant nature and which are easily water soluble and/or capable of absorbing water, are suitable as dispersing agents for surfactants or surfactant combinations which cause difficulties from the point of view of difficult solubility and/or gel formation. The tendency of detergent concentrates to form a gel can, for example, often be easily counteracted by the concomitant use of a limited amount of water soluble inorganic salts. Examples of such include sodium sulfate and/or sodium chloride. Often the dissolving behavior of the paste- or dough-like detergent preparations can be substantially influenced by the combination of difficultly soluble surfactants in admixture with easily soluble surfactants.

Of particular importance in this regard is a substantially insoluble component which for its part can act in various ways in the washing process. Employed here is the known sodium di-salt of alpha- sulfo fatty acids, particularly predominantly obtained from $C_{16-18}$- fatty acids. Substances of this type are present in detergent mixtures in finely-divided form. The components not only have a specific surfactant effect, they also simultaneously provide "builder" properties by bonding water hardness and making, in particular when combined with layered silicate of the montmorillonite type, the textiles washed with it feel soft. Surprisingly, it has been shown that di-salt dispersions can be of great importance as versatile, useful dispersing agents in the dilution or dissolving stages of paste- to dough-like detergent concentrate preparations. Often limited amounts of di-salts in the range of 5 to 50% by weight maximum, preferably in the range of 5 to 25% by weight di-salts, with respect to the mixture of difficultly soluble surfactant+di-salt, are sufficient to ensure a definite accelerated dissolving or dispersing behavior of the paste-like preparation. With the difficultly soluble surfactant components, for example tallow alcohol ethoxy containing 11 moles of ethylene oxide (Dehydol TA 11), the additive has a more distinct effect on the sulfo fatty acid di-salts based on $C_{16-18}$-fatty acid, which are to a large extent water insoluble at room temperature, than the use of the same quantity of easily water soluble inorganic salt, for example such as sodium chloride.

According to the invention, preferred usable detergent concentrates which are stable in form can also be determined by their viscosity. Particularly suitable are preparations whose viscosity (Höppler- viscosimeter) at 35° C. does not exceed approximately 350,000 mPa.s and particularly 250,000 mPa.s. At room temperature (20° +2° C.) the upper limit for the viscosity value lies at million mPa.s, determined by the Brookfield-Helipath method. Preparations having a consistency of a distinctly higher viscosity, e.g. in the range of 2.5 million mPa.s or above, are distinguished by a very slow dissolving behavior.

The lower viscosity limit lies in the range of lotions, which are sufficiently stable in form, as is known for example from the range of pastes for hand-washing. The numerical value can be given here as approximately from 12,000 to 15,000 mPa.s (Höppler-Viscosimeter) at room temperature. Particularly suitable are pastes which have a viscosity at room temperature in the range of approximately 15,000 to 300,000 mPa.s, and preferably not more than approximately 200,000 mPa.s.

The detergent preparations according to the invention, particularly those based on an aqueous detergent concentrate contain as well as the wash-active surfactants further customary textile detergent constituents such as organic and/or inorganic "builder" components, washing alkalis, soil-suspending agents, enzymes, color-brighteners, fragrances, dyestuffs and the like. Here we refer in detail to the extensive knowledge of the experts, see for example Ullmann "Enzyklopädie der technischen Chemie" 4th edition, Volume 24, Detergents, in particular loc. cit. Pages 68 to 102.

In the practical implementation of the washing process according to the invention, the procedure is as follows. The textile material to be washed is placed in the machine while dry, or it may be from slightly damp to dripping wet. The required amount of paste- or dough-like detergent concentrate is added to the textile material. It may be advantageous here to put the detergent concentrate on a white and/or color fast textile article which contains markings for the right dosage of detergent depending on the hardness of the water (see FIG. 1). If desired, the amount of paste- or dough-like detergent concentrate can be enveloped in such an article of textile and be put in the machine with the textile articles to be washed. Even if such particular steps are not carried out, because of the consistency and paste- or dough-like nature of the detergent, which is stable in form, or of the concentrations used according to the invention, it can be ensured that no unwanted diffusion of the detergent concentrate in the textiles takes place prematurely. There is an important advantage here of the process according to the invention as against the direct dosing of a liquid detergent in the textile articles to be washed. This advantage shows itself even more pronouncedly in that by the addition of water, even under the conditions of the textile washing mechanics, a delayed dissolution of the paste- or dough-like detergent concentrates takes place in the aqueous phase, so the danger of the formation of locally excessive concentrations is significantly reduced. This can be important, for example, in such cases where by excessive concentration of detergent constituents there is the risk of the formation of spatially limited missed places.

In an important embodiment of the process according to the invention, the formation of the washing liquor is carried out by gradual addition of water to the textile articles containing the detergent concentrate. Thereby, in particular, the treatment time of the textile articles is prolonged under the washing conditions in the machine which is characterised by the amount of water or washing liquor, which corresponds approximately to that of the dripping wet textile articles in the machine load. The conventional machine washing is known to work with an amount of liquid which corresponds to multiples of the dripping-wet condition. According to the nature of the textile, this dripping-wet condition can require an amount of water which corresponds approximately to 2 to 3 times the textile dry weight. In the preferred embodiment of the process according to the invention discussed herein, it may be desirable to use a longer treatment time of the textile articles to be washed in this dilution stage, in which, as stated, the amount of water added corresponds to about 2 to 4 times the textile dry weight. If under these conditions the time of the wetting process is prolonged, in particular when the textiles are undergoing rotation, before adding the final concentration of the detergent liquor which has been more diluted by the further addition of water, a strong acceleration of the wetting effect and with that a strong acceleration of the cleaning effect takes place. It may be preferable to extend this processing time by at least a few minutes, e.g., in the range of from approximately 5 to 15 minutes. The treatment of the textile articles in this processing stage, and also naturally in all the other stages of the machine washing process according to the invention, can take place at room temperature or can be accelerated by the use of elevated temperatures.

The process according to the invention can be carried out in all the usual types of washing machines, in particular therefore, in the known household washing machines with a horizontally-arranged drum, which are either front or top loading.

The process according to the invention is, however, also particularly suitable for use in washing machines in which the heating of the damp to dripping-wet textile articles is carried out by the action of microwaves on the textile material which has been thoroughly wetted. Moreover, this heating up of the wet textile articles in the wetting or washing stages of the process with the washing liquor formed in situ and/or with the requirement of one or more rinsing stages can be useful. The implementation of such a washing process with the use of microwaves is particularly suitable for the embodiment of the process according to the invention already described, which works with a gradual formation of the washing liquor and there is a required treatment stage of at least a few minutes, preferably from approximately 3 to 15 minutes, in which the amount of water corresponds approximately to 2 to 4 times, but preferably 2 to 3 times, the dry weight of the textile. Details of this process are described in previously filed German Patent application No. P 37 07 147.5 titled "Process for Washing and/or Rinsing Textile Materials as well as Suitable Appliances Therefor", whose disclosures have also been used as the subject of the disclosures of the present invention.

In an important embodiment of the process according to the invention, working temperatures in the range of room temperature to only moderately elevated temperatures may be employed particularly during the wetting process of the soiled textile articles with the comparatively concentrated washing liquor, wherein the amount of water in the wetting stage is limited in the sense previously given, to make the textile at the most dripping wet, as well as the usual standard dosage of detergents or detergent mixtures from conventional textile washing being employed. In this embodiment, therefore, it may be useful to carry out the wetting of the soiled textile articles under damp conditions in the temperature range of approximately 15° C. to a maximum of 50° C., in particular in the range of approximately 18° to 40° C. The use of microwaves is a suitable means for this embodiment of the process according to the invention, which necessitates only limited amounts of energy, the invention however is in no way limited to it. The possible desired input of heat energy can be brought about in other ways, for example by the introduction of steam, and the associated release of the latent heat of vaporization by condensation of the steam, and/or by other forms of energy irradiation, e.g. IR-radiation.

The teaching according to the invention of the use of detergent constituents as paste- or dough-like preparations, which are at least to a large extent stable in form at room temperature, has many other important advantages over the known use of liquid detergents. The preparations having the consistency according to the invention can remain in a homogeneous mixture state for practically any period of storage desired, if the components are not homogeneously soluble in one another. Such a case can always occur for example, if in addition to fluid components, in particular corresponding surfactants, insoluble finely divided mixture components, in particular "builders" e.g. based on NaA zeolite and/or absorbent layered silicate, but also inorganic salts with or without "builder" effect are also used.

For the production of heterogeneous detergent formulations in paste, gel or dough form, stable in storage, corresponding preparations with a viscosity (Höppler-viscosity at room temperature) of at least approximately 70,000 mPa.s and preferably of at least approximately 100,000 mPa.s are particularly suitable.

The adjustment of the paste-, gel- or of the dough-like condition of the detergent formulations used according to the invention may be performed in a manner known per se, e.g., by the addition of water and/or organic, preferably water soluble solvents, if the combination of active materials as such is too solid or conversely by limiting the contents of these liquid components in the formulations and/or by concomitantly using thickening agents if the detergent composition is too highly fluid. Suitable thickening agents include for example natural polymer compounds such as carboxymethyl cellulose or methyl cellulose, guar compounds and the like, as well as synthetic polymer components of the polyacrylate and/or polymethacrylate type, which can also be partially cross-linked. Suitable for thickening detergent mixtures which are too highly fluid also in particular include selected surfactant components having a thickening effect. Examples which can be named include soap, as well as solid or difficultly soluble surfactant components, in particular corresponding anionic or nonionic surfactants. Use can also be made, if desired, of the known tendency to form gels, which occurs by the addition of small amounts of electrolyte salts to aqueous solutions and of selected surfactants, in particular those based on fatty alcohol ether sulfates. Other suitable thickening agents are absorbent layered silicates of natural and/or synthetic origin, which are also known to be able to perform a specific function in the field of textile washing.

The detergent formulations in paste or gel form, or also of a dough-like composition used according to the invention which are to a large extent stable in form preferably have a neutral to moderately alkaline pH-value, in particular in the range of approximately from 7 to 12, preferably in the range of approximately 7 to 10. The usual washing alkalis and/or neutralisation agents, e.g. based on citric acid, are suitable for the pH-value adjustment. The determination of the pH- value is carried out on 1% aqueous solutions.

With regard to the composition of the detergent preparation, a preferred embodiment of the process according to the invention is characterized in that a detergent concentrate based on nonionic surfactant is used, which contains a fluid surfactant component comprising:

(a) addition products of 2 to 8 moles of ethylene oxide to 1 mole of fatty alcohol having 10 to 20 carbon atoms;

(b) anionic surfactants of the sulfate, sulfonate, and soap type, (c) polyethylene glycol having a molecular weight of approximately 200 to 600, with the requirement, that the amount of constituents (a)+(b)+(c) is greater than 20% by weight, in particular 20 50% by weight of the whole detergent, whereby the ratio (a):(b) lies in the range of more than 2:1 to 3:1 and has a density of less than 1.4 to 1.2 and is practically water- and gas-free.

A detergent of this type has the necessary rheological properties for dosing by means of a dosing cloth while at the same time maintaining the required high solubility of the detergent concentrate and excellent washing capability. In addition to this, convenient handling when dosing is advantageous.

For use with textile articles, the paste-like detergent concentrate is preferably applied on a white or colorfast article of textile as a dosage cloth, with markings for the required strand length of the detergent paste and if desired the detergent is enveloped in it. The markings take into account the hardness of the water used for washing and the cross-section of the strand resulting from the tube opening. An example of the dosage cloth mentioned is shown in the diagram (FIG. 1).

For literature on conventional detergent mixtures and their standard ingredients, the extensive relevant patent literature is additionally referred to, from which for example, the following U.S. Pat. Nos. 3,936,537, 3,664,961, 3,919,678, 4,222,905 and 4,239,659 can be mentioned.

EXAMPLES 1 AND 2

Two detergent preparations in paste-form which were not fluid at room temperature were prepared according to the following procedure. The numerical values for the pastes 1 and 2 in the following Table 1 are weight percentages of the paste-form detergent mixtures.

TABLE 1

| Example | Paste 1 | Paste 2 |
|---|---|---|
| alpha-sulfo-$C_{16-18}$-fatty acid-, di-sodium salt | 18.0% | 25.0% |
| Tallow sulfate | 11.0% | 15.0% |
| Coconut fatty acid | 2.0% | 4.0% |
| Triethanolamine | 0.5% | 1.0% |
| $MgSO_4 \cdot 7H_2O$ | 8.0% | 10.0% |
| Fatty alcohol + ethylene oxide/propylene oxide (Dehypon LT 24) | 3.0% | 3.0% |
| Phosphonate, 33% | 1.5% | 1.5% |
| Enzyme | 0.8% | 0.8% |
| Ethanol | | 10.0% |
| Propylene glycol-1,2 | | 5.0% |
| Water | remainder to 100% | remainder to 100% |
| % Wash-active substances (WAS) | 34 | 47 |
| pH-value (1% solution) | 8.0 | 8.2 |

The manufacture of the pastes in detail was as follows:

Water and triethanolamine were put in a container, the fatty acids were dissolved at approximately 50° C. in the liquid phase, then the surfactant components were stirred in. Finally the remaining components, including in the case of example 2 the water miscible organic solvent used, were added.

The paste of example 1 had a value of 218,750 mPa.s in the determination of viscosity with the Brookfield-Helipath RVF (Spindle T-E, 4 r.p.m).

In a European standard front-loading washing machine with horizontally-arranged drum, comparative washing tests were carried out on standard-soiled test textiles. The paste-like detergent formulations of examples 1 and 2 according to the invention were put directly onto an article of white textile from the machine load and in this form added in the drum to the textile articles to be washed before the start of the washing process.

For comparison, a standard commercial liquid detergent was added in the conventional way to the dispenser of the machine in a corresponding washing test.

In the following Table 2 the remission values obtained from washing with the pastes from examples 1 and 2 according to the invention were summarized and assembled with the corresponding values from the comparative tests on standard liquid detergent. The conditions of the washing process were as follows in all cases: water temperature 40° C., textile to liquor ratio 1:30, water hardness 16° dH, required dosage 10 g of the detergent mixture/1 of washing liquor.

TABLE 2

| | % Remission of the washed test materials | | |
|---|---|---|---|
| Example | Paste 1 | Paste 2 | Standard commercial liquid detergent |
| DW-C | 64.5 | 72.1 | 66.9 |
| DSF-PC | 66.3 | 70.4 | 71.6 |
| DSF-PPC | 62.0 | 63.6 | 54.7 |
| DSF-P | 57.2 | 64.0 | 68.5 |
| SO-C | 43.5 | 49.1 | 43.9 |
| M-PPC | 62.5 | 63.5 | 63.3 |
| MU-PPC | 56.4 | 58.7 | 57.3 |
| LS-PPC | 38.7 | 42.6 | 46.2 |
| RW-PC | 42.5 | 44.5 | 40.0 |
| T-PC | 37.2 | 48.6 | 38.2 |
| K-PC | 56.6 | 58.5 | 58.3 |
| MK-C | 75.5 | 76.7 | 75.0 |

TABLE 2-continued

| | % Remission of the washed test materials | | |
|---|---|---|---|
| Example | Paste 1 | Paste 2 | Standard commercial liquid detergent |
| MS-C | 73.6 | 76.1 | 76.6 |
| BMS-C | 72.0 | 75.2 | 71.9 |

The washed test materials are each identified according to the type of soil and to the textile carrier. The following key explains this:

| Type of soil | |
|---|---|
| DW = | Dust/Wool fat |
| DSF = | Dust/Skin fat |
| SO = | Soot/Olive oil |
| M = | Mineral oil |
| MU = | Make-up |
| LS = | Lip Stick |
| RW = | Red Wine |
| T = | Tea |
| K = | Cocoa |
| MK = | Milk/Cocoa |
| MS = | Milk/Soot |
| BMS = | Blood/Milk/Soot |

General types of textiles

C=Cotton, PC=Processed Cotton, PPC=Polyester/Processed Cotton, P=Polyester

In the following examples 3 to 11, various paste compositions and their preparation are described which can be used in the process according to the invention. Following example 11, a summary is given of the viscosity values for the pastes from these examples 3 to 11 in Table 3.

EXAMPLE 3

| | |
|---|---|
| 16.0% | alkyl benzenesulphonate (ABS) |
| 15.0% | Coconut-tallow (1:1)-sulphate (AS Sulfopon KT115) |
| 25.0% | Sodium tripolyphosphate (NaTPP) |
| 2.0% | Carboxymethylcellulose (CMC) |
| Remainder =31% WAS | Water |
| white, soft paste | |

Preparation:

CMS was allowed to pre-soak in part of the water, ABS was added and dissolved at approximately 50° C. Fatty alcohol sulfate was homogeneously mixed in. The remaining water was added, and finally NaTPP was worked in homogeneously.

EXAMPLE 4

| | |
|---|---|
| 13.5% | ABS-Monoethanolamine salt |
| 10.0% | Fatty alcohol ethoxylate (Dehydol LT7) |
| 5.0% | Fatty alcohol ethoxylate (Dehydol TA5) |
| 1.5% | Comperlan KD (Coconut fatty acid diethanolamide) |
| 10.0% | Water-glass 58/80 |
| 5.0% | CMC |
| Remainder =30% WAS | Water |
| yellowish, soft, turbid paste | |

Preparation:

CMC was allowed to pre-soak in part of the water, the remaining compounds were dissolved one after the other at 50° C. The remaining water and then the water glass were added.

EXAMPLE 5

| | |
|---|---|
| 14.0% | $C_{16-18}$-ester sulphonate (AS Texin ES 68) |
| 5.0% | (Dehydol LT7) |
| 3.0% | (Comperlan KD) |
| 3.5% | CMC |
| Remainder | Water |
| =22% WAS | |
| Light beige, soft paste | |

Preparation:

The water was put in a container, the CMC was allowed to soak in it, then the Texin ES 68, Dehydol LT7 and Comperlan KD were stirred in at approximately 50° C.

EXAMPLE 6

| | |
|---|---|
| 10.0% | Fatty acid (Edenor KPK 1218) |
| 2.0% | NaOH tablet |
| 19.0% | $C_{12-18}$-sulphate (Sulfopon K35) |
| 1.0% | CMC |
| Remainder | Water |
| =30% WAS | |
| white, soft paste | |

Preparation:

The water and NaOH were put in a container, the CMC was allowed to soak in it, then the fatty acid was dissolved at approximately 70° C. Finally, the Sulfopon K35 was stirred in.

EXAMPLE 7

| | |
|---|---|
| 5.0% | Coconut/Palm kernel-fatty acid (Edenor KPK 1218) |
| 1.0% | NaOH tablet |
| 21.0% | Coconut-tallow (1:1)-sulphate (Sulfopon KT 115) |
| 1.0% | CMC |
| Remainder | Water |
| =27% WAS | |
| white, soft paste | |

Preparation:

same as example 6.

EXAMPLE 8

| | |
|---|---|
| 13.5% | ABS |
| 8.0% | Eumulgin WM 10 (Fatty alcohol ethoxylate) |
| 3.0% | Na-sulphate |
| 2.5% | Na-chloride |
| 4.0% | CMC |
| Remainder | Water |
| =21% WAS | |
| Light beige, soft paste | |

Preparation:

The water was put in a container, the CMC was allowed to soak in it, the ABS and fatty alcohol ethoxylate were dissolved, obtionally by warming, then the salts were stirred in.

EXAMPLE 9

| | |
|---|---|
| 13.5% | ABS |
| 3.0% | Dehydol LT7 |
| 0.5% | Comperlan KD |

-continued

| | |
|---|---|
| 2.0% | Fatty acid (Edenor KPK 1218) |
| 0.5% | NaOH-tablet |
| 4.0% | CMC |
| 3.0% | NaTTP |
| Remainder | Water |
| =20% WAS | |
| White, fluid paste. | |

Preparation:

The water and the NaOH were put in a container, the CMC was allowed to soak in it, the fatty acids were dissolved at approximately 70° C., then the surfactants were dissolved, and finally the NaTPP was stirred in.

EXAMPLE 10

| | |
|---|---|
| 10.0% | ABS |
| 12.0% | Dehydol LT7 |
| 9.4% | Fatty acid (KPK 1218) |
| 3.7% | Triethanolamine (TEA) |
| 2.0% | NaOH-tablet |
| 5.0% | Glycerol |
| Remainder | Water |
| =32% WAS | |
| Beige, soft paste. | |

Preparation:

The water and NaOH were put in a container, the fatty acids were dissolved at approximately 70° C., the TEA was added, the ABS and the Dehydol LT7 were stirred in, then the glycerol was added.

EXAMPLE 11

| | |
|---|---|
| 14.0% | ABS |
| 16.0% | Dehydol LT7 |
| 4.0% | Edenor HTL (Fatty acids) |
| 9.0% | Edenor K 1218 (Fatty Acid) |
| 5.0% | Triethanolamine (TEA) |
| 1.0% | Turpinal 2046 (Phosphonate) |
| 0.5% | Glycerol |
| Remainder | Water |
| =43% WAS | |
| Light beige fluid paste. | |

Preparation:

The water and the TEA were put in a container, the fatty acids were dissolved at approximately 50° C., the ABS and Dehydol LT7 were stirred in, then the phosphate and glycerol were mixed in the composition.

TABLE 3

Viscosity of the detergent pastes from examples 3 to 11 at room temperature: Brookfield-Helipath RVF, Speed: 4 r.p.m., Spindle: T- . . . Measurement at 21° C.:

| | |
|---|---|
| Example 3 | 400,000 mPa.s (T-E) |
| Example 4 | 50,500 mPa.s (T-D) |
| Example 5 | 66,500 mPa.s (T-D) |
| Example 6 | 450,000 mPa.s (T-E) |
| Example 7 | 875,000 mPa.s (T-E) |
| Example 8 | 55,000 mPa.s (T-D) |
| Example 9 | 16,850 mPa.s (T-C) |
| Example 10 | 575,000 mPa.s (T-E) |
| Example 11 | 16,850 mPa.s (T-C) |

EXAMPLE 12

A paste-like detergent of the following composition was produced by mixing the following constituents:

| | |
|---|---|
| 35.5% by weight | $C_{12-14}$-fatty alcohol + 3 Moles ethylene oxide |
| 8.9% by weight | $C_{12-18}$-fatty alcohol + 5 moles ethylene oxide |
| 15.0% by weight | Alkyl benzene sulphonate, powder |
| 4.0% by weight | $C_{16-22}$-Soap |
| 3.95% by weight | Polyethylene glycol, molecular weight 400 |
| 20.0% by weight | Sodium tripolyphosphate |
| 10.0% by weight | Sodium perborate, monohydrate |
| 1.0% by weight | Phosphonate |
| 0.2% by weight | Optical brightener |
| 0.05% by weight | Dyestuff |
| 0.5% by weight | Enzyme (Alkalase) |
| 0.5% by weight | Silicone anti-foam agent |

The paste-like mixture was ground while wet and the gas was extracted by applying a vacuum. The mixture had a density of 1.3 g/l.

This paste-like detergent was easily squeezable out of both a tube with a wedge-shaped bottom and a circular opening of approximately 16 millimeters diameter as well as out of a harmonica shaped collapsible tube (Faltenbalg-Tube) with a circular opening of approximately 22 millimeters onto an absorbent cloth. The strand of detergent does not run in spite of the absorbent capacity of the cloth after it has been squeezed out onto the cloth. The cloth with the detergent strand can be folded together and put on top of the washing in the washing machine, without the detergent paste soaking through. The paste was dissolved in a short time (approximately 10 minutes) after the start of the washing program of the automatic drum washing machine. The washing result was excellent.

We claim:

1. A process for machine washing soiled textile articles with a washing liquor containing water and wash-active surfactants comprising adding a determined amount of a detergent concentrate containing surfactants to a dosing cloth having markings therein to enable determining the quantity of said detergent concentrate to be added to the textile articles to be washed while the articles are dry or slightly damp, and forming the washing liquor by the addition of water to the textile articles over a period of from about 5 to about 15 minutes in the amount of from about 2 to about 4 times the dry weight of said textile articles while rotating the textile articles, said detergent concentrate comprising a form-stable, paste-like or dough-like substance at room temperature.

2. A process according to claim 1 wherein said detergent concentrate contains water or a water-soluble solvent and up to about 75% by weight of surfactants, based on the weight of the concentrate, and said detergent concentrate has a spreadable to kneadable consistency.

3. A process according to claim 1 wherein said detergent concentrate contains a dispersing agent comprising a surfactant which at room temperature is substantially insoluble in water or has a tendency to gel.

4. A process according to claim 1 wherein said detergent concentrate contains a dispersing agent comprising a water-soluble or water-absorbing organic or inorganic additive.

5. A process according to claim 1 wherein said detergent concentrate has a viscosity at room temperature of up to about 1 million mPa.s.

6. A process according to claim 1 wherein said detergent concentrate has a viscosity of about 20° C. of between about 15,000 to about 300,000 mPa.s.

7. A process according to claim 1 wherein said detergent concentrate has a dissolving power in water of at least about 40% by weight.

8. A process according to claim 1 wherein said detergent concentrate is applied to a white or color-fast textile article.

9. A process according to claim 1 wherein said detergent concentrate also contains an organic or inorganic builder component, washing alkali, soil-suspending agent, enzyme, color-brightener, fragrance and dyestuff.

10. A process according to claim 1 wherein said detergent concentrate contains a disalt of an alpha-sulfo fatty acid.

11. A process according to claim 1 including extending the duration of the treatment of the textile articles during the formation of said washing liquor.

12. A process according to claim 1 wherein said surfactants are selected from the group consisting of (a) the addition product of a $C_{12}$–$C_{20}$ fatty alcohol containing from about 2 to about 8 moles of ethylene oxide per mole of said fatty alcohol, (b) an anionic surfactant of the sulfate, sulfonate and soap type, and (c) a polyethylene glycol having a molecular weight of from about 200 to about 600, and wherein the amount of components (a)+(b)+(c) is more than about 20%/wt, based on the weight of said detergent concentrate, and the ratio of component (a) to component (b) is about 2:1 to 3:1.

* * * * *